US007665820B2

(12) United States Patent
Matsuhashi

(10) Patent No.: US 7,665,820 B2
(45) Date of Patent: Feb. 23, 2010

(54) LIQUID EJECTION APPARATUS

(75) Inventor: Kunihiko Matsuhashi, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 568 days.

(21) Appl. No.: 11/509,766

(22) Filed: Aug. 25, 2006

(65) Prior Publication Data

US 2007/0046723 A1 Mar. 1, 2007

(30) Foreign Application Priority Data

Aug. 25, 2005 (JP) ..... 2005-244565
Oct. 7, 2005 (JP) ..... 2005-295062
Oct. 24, 2005 (JP) ..... 2005-308859

(51) Int. Cl.
*B41J 2/165* (2006.01)
*B41J 2/01* (2006.01)

(52) U.S. Cl. ..... 347/22; 347/32; 347/35; 347/104

(58) Field of Classification Search ..... 347/22, 347/32, 102, 104, 35
See application file for complete search history.

(56) References Cited

U.S. PATENT DOCUMENTS 5,631,685 A * 5/1997 Gooray et al. ..... 347/102
6,137,515 A 10/2000 Dickinson
6,896,349 B2 * 5/2005 Valero et al. ..... 347/22
7,267,418 B2 9/2007 Hasebe et al.
2006/0164491 A1 * 7/2006 Sakuma et al.

FOREIGN PATENT DOCUMENTS

| | | | |
|---|---|---|---|
| EP | 0 316 198 | A2 | 5/1989 |
| EP | 1 040 930 | A2 | 10/2000 |
| EP | 1 502 748 | A1 | 2/2005 |
| JP | 10-128964 | A | 5/1998 |
| JP | 2001-105628 | A | 4/2001 |
| JP | 2001-150690 | A | 6/2001 |
| JP | 2001-158162 | A | 6/2001 |
| JP | 2001-347690 | A | 12/2001 |
| JP | 2002-019094 | A | 1/2002 |
| JP | 2002-103588 | A | 4/2002 |
| JP | 2002-192737 | A | 7/2002 |
| JP | 2003-334976 | A | 11/2003 |
| JP | 2004-202842 | A | 7/2004 |
| JP | 2005-053021 | A | 3/2005 |
| JP | 2005-178072 | A | 7/2005 |

* cited by examiner

*Primary Examiner*—Shih-wen Hsieh
(74) *Attorney, Agent, or Firm*—Sughrue Mion, PLLC

(57) ABSTRACT

A printer functioning as a liquid ejection apparatus includes a recording head having nozzles, a flushing sheet feeding mechanism, and a cleaning mechanism. The flushing sheet feeding mechanism feeds a flushing sheet for absorbing ink, which is ejected from the nozzles, from a non-flushing position separated from the recording head to a flushing position facing the recording head and from the flushing position to the non-flushing position during flushing. The cleaning mechanism removes the ink absorbed in the flushing sheet after flushing.

15 Claims, 13 Drawing Sheets

LIQUID EJECTION APPARATUS

BACKGROUND OF THE INVENTION

The present invention relates to a liquid ejection apparatus.

An inkjet printer (hereafter simply as a "printer") is one known apparatus for ejecting liquid to a target. The printer has a recording head (liquid ejection head) and supplies ink (liquid) from an ink cartridge to the recording head. The ink is ejected from nozzles of the recording head to a recording medium, which functions as a target. To print photograph images generated by digital cameras, printers having a "marginless printing" function, that is, printers for printing on the entire surface of a recording medium, have been recently proposed. As one example, Japanese Laid-Open Patent Publication No. 2001-158162 describes a printer having the marginless printing function.

In this type of printer, the solvent included in the ink tends to evaporate through the nozzles of the recording head. This may increase the viscosity of the ink or solidify the ink. Further, the nozzles of the recording head may be clogged by dust adhered to the nozzles or air bubbles entering the nozzles. To eliminate such problems, in addition to ejecting ink toward a printing recording medium, the printer performs a flushing operation for forcibly ejecting ink toward a recording medium.

To enable high speed printing, printers with a large recording head having nozzles aligned in a direction perpendicular to the feeding direction of a recording medium throughout the entire width of a print area (referred to as full-line head printers) have been proposed. When such a full-line head printer performs a flushing operation, the printer ejects ink to a feeding belt, which feeds a recording medium, without moving its recording head from a print position. The ink on the feeding belt is wiped off afterwards. However, the ink on the feeding belt may not be wiped off completely. In this case, the residual ink may stain a recording medium that is fed after the flushing operation.

To solve the above problem, for example, Japanese Laid-Open Patent Publication No. 2001-105628 describes a method for feeding a flushing sheet, which is formed from an absorbent, to a position immediately below a recording head with a feeding belt and ejecting ink onto the flushing sheet. With this method, the ink is not directly ejected onto the feeding belt. Thus, neither the feeding belt nor a recording medium that is fed after the flushing operation is stained.

A printer using the above method dries the flushing sheet after the flushing operation and reuses the flushing sheet. The flushing sheet is disposed of when the amount of ink absorbed in the sheet exceeds a tolerable range. However, when the single flushing sheet is used repeatedly, the flushing sheet absorbing ink may not be dried in time for the next use of the flushing sheet. As a result, the flushing sheet may have low absorbency when the sheet is used again. Further, the ink may stain the user's hands and clothes when disposing of the used flushing sheet.

SUMMARY OF THE INVENTION

It is an object of the present invention to provide a liquid ejection apparatus for enabling efficient use of a flushing sheet.

One aspect of the present is a liquid ejection apparatus for ejecting liquid to a target. The apparatus is provided with a liquid ejection head including a liquid ejection nozzle. A flushing sheet feeding mechanism for feeding a flushing sheet from a non-flushing position (a first position) separated from the liquid ejection nozzle to a flushing position (a second position) facing the liquid ejection nozzle and from the flushing position to the non-flushing position during a flushing operation. The flushing sheet absorbs liquid ejected from the liquid ejection nozzle. A cleaning mechanism, arranged on a passage for feeding the flushing sheet, removes the liquid absorbed in the flushing sheet after the flushing sheet is used in the flushing operation.

Another aspect of the present invention is a liquid ejection apparatus for ejecting a liquid to a target. The apparatus is provided with a liquid ejection head including a liquid ejection nozzle. A target accommodation unit accommodates the target at a liquid non-ejection position (a first position) separated from the liquid ejection head. A liquid receiving sheet accommodation unit accommodates a liquid receiving sheet having a larger size than the target at the liquid non-ejection position. A feeding mechanism feeds the target, which is fed from the target accommodation unit, to a liquid ejection position (a second position) facing the liquid ejection head when the target is placed on the liquid receiving sheet, which is fed from the liquid receiving sheet accommodation unit, during a marginless ejection operation for ejecting the liquid to the entire surface of the target.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

First Embodiment

A first embodiment of the present invention will now be described with reference to FIGS. 1 to 7.

Figure 1:
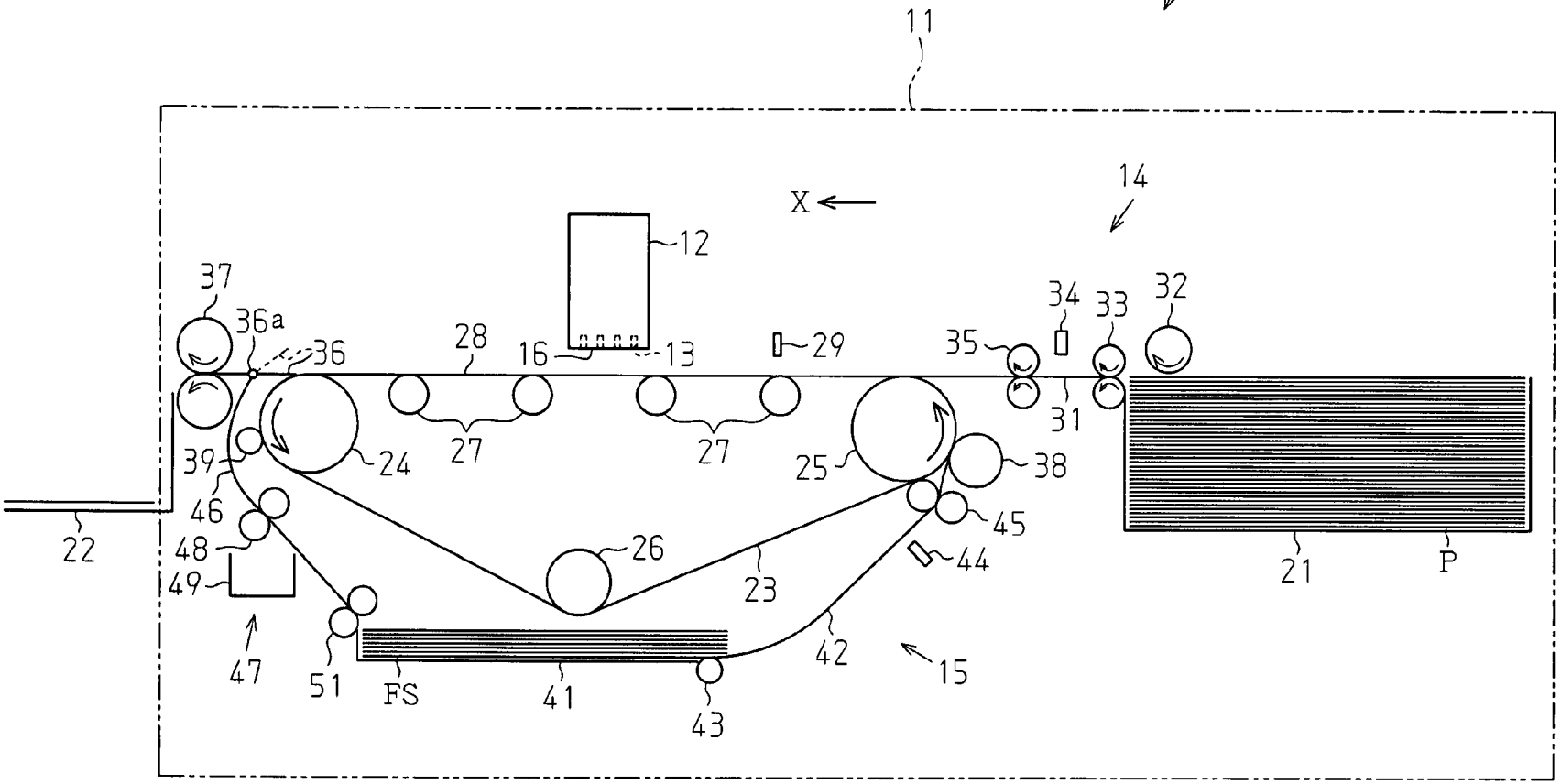
FIG. 1 is a schematic view showing an overall structure of a printer according to a first embodiment of the present invention.

As shown in FIG. 1, a printer 10, which functions as a liquid ejection apparatus, includes a main body case 11, which is generally box-shaped. A recording head 12 (liquid ejection head) for ejecting ink (liquid) to a paper P, which functions as a target, is arranged in the main body case 11.

A plurality of nozzles 13 are arranged on a lower surface of the recording head 12 in a direction intersecting with the feeding direction of the paper P (X-arrow direction in FIG. 1) throughout the entire width of a print area of the paper P. The printer 10 having such a recording head (referred to as a full-line head printer) is more suitable for high speed printing than a printer having its recording head moving with a carriage.

A plurality of ink cartridges (not shown) are connected to the recording head 12. During printing, the ink contained in each ink cartridge is supplied to the recording head 12 under a predetermined pressure.

In the main body case 11, a paper feeding mechanism (target feeding mechanism) 14 for feeding a paper P and a flushing sheet feeding mechanism 15 for feeding a flushing sheet FS are arranged below the recording head 12. The flushing sheet FS is used in a flushing operation to absorb the ink ejected from the nozzles 13. The flushing sheet FS has an appropriate ink absorbency (e.g. 15 mg/sq. in. or more). The flushing operation is performed when a predetermined time (e.g. 10 seconds) elapses when performing printing on the paper P (normal printing).

The paper feeding mechanism 14 includes a paper feed tray 21 for holding papers P, a paper discharge tray 22 for holding papers P after printing (printed papers), and a feeding belt 23 for feeding each paper P to a position immediately below the recording head 12 (to a position facing a nozzle formation surface 16). The feeding belt 23 connects a drive roller 24, a driven roller 25, and a tension roller 26 to form a triangular shape. The drive roller 24 is driven after printing is started. The driven roller 25 rotates as it follows the rotation of the drive roller 24. The tension roller 26 is arranged between the drive roller 24 and the driven roller 25.

Four auxiliary feed rollers 27 are arranged between the drive roller 24 and the driven roller 25. Part of the feeding belt 23 between the drive roller 24 and the driven roller 25 is supported horizontally by the auxiliary feed rollers 27 from underneath. The part of the feeding belt 23 supported horizontally forms a main feeding passage 28. A first sensor 29 is arranged in proximity to the main feeding passage 28. The first sensor 29 is arranged between the paper feed tray 21 and the recording head 12. The first sensor 29 detects an initial point of detection that starts a counting operation for determining a feeding amount of a paper P (flushing sheet FS), which is fed to a position immediately below the recording head 12. The count operation for determining the feeding amount is started when the paper P (flushing sheet FS) passes by the first sensor 29

A first guide plate 31 for guiding a paper P from the paper feed tray 21 to the main feeding passage 28 is arranged between the paper feed tray 21 and the feeding belt 23. A pickup roller 32 for picking up papers P from the paper feed tray 21 is arranged above the paper feed tray 21. Separation rollers 33 are arranged at a point of connection between the paper feed tray 21 and the first guide plate 31. Papers P taken out from the paper feed tray 21 are separated from one another by the separation rollers 33 so that only a single paper P is fed at a time onto the first guide plate 31.

A second sensor 34 is arranged in proximity to the first guide plate 31. The second sensor 34 detects a paper P has passed the two separation rollers 33. Two paper gate rollers 35 are arranged between the first guide plate 31 and the main feeding passage 28. The pickup roller 32, the separation rollers 33, and the paper gate rollers 35 rotate in predetermined directions to feed a paper P from the paper feed tray 21 onto the main feeding passage 28.

A selector 36 is arranged between the feeding belt 23 and the paper discharge tray 22. The selector 36 switches between feeding of a paper P from the main feeding passage 28 to the paper discharge tray 22 and feeding of a flushing sheet FS from the main feeding passage 28 to a cleaning mechanism 47. The selector 36 is pivotally supported about its basal end 36*a*. When the selector 36 is in a horizontal state (closed state) as indicated by the solid line in FIG. 1, the main feeding passage 28 and the paper discharge tray 22 are connected by the selector 36. When the selector 36 is in a tilted state (open state) as indicted by a broken line in FIG. 1, the main feeding passage 28 and the cleaning mechanism 47 are connected by the selector 36.

Two paper discharge rollers 37 are arranged between the basal end 36*a* of the selector 36 and the paper discharge tray 22. The paper discharge rollers 37 are used to discharge a printed paper P onto the paper discharge tray 22. When the selector 36 is in the horizontal state, rotation of the feeding belt 23 and the paper discharge roller 37 causes the printed paper P to be discharged from the main feeding passage 28 onto the paper discharge tray 22.

An electric-charging roller 38 is rotatably supported by the driven roller 25. The electric-charging roller 38 is arranged to sandwich the feeding belt 23 with the driven roller 25. The electric-charging roller 38 negatively charges the entire surface of the feeding belt 23. The paper P or the flushing sheet FS is attracted to and held on the main feeding passage 28 of the feeding belt 23 that is electrically charged. An electric-discharging roller 39 is rotatably supported by the drive roller 24. The electric-discharging roller 39 is arranged to sandwich the feeding belt 23 with the drive roller 24.

The flushing sheet feeding mechanism 15 includes a flushing sheet tray 41 for holding flushing sheets FS and the feeding belt 23 for feeding each flushing sheet FS to the position immediately below the recording head 12. In this way, the feeding belt 23 is used by both the paper feeding mechanism 14 and the flushing sheet feeding mechanism 15.

The flushing sheet tray 41 is arranged below the feeding belt 23. A second guide plate 42 for guiding a flushing sheet FS from the flushing sheet tray 41 to the main feeding passage 28 is arranged between the flushing sheet tray 41 and the driven roller 25. The second guide plate 42 is formed by two parallel, spaced, curved, and elongated plates. A flushing sheet feed roller 43 for feeding a flushing sheet FS from the flushing sheet tray 41 onto the second guide plate 42 is arranged at a bottom of the flushing sheet tray 41.

A third sensor 44 for detecting the flushing sheet FS is arranged below an upper portion of the second guide plate 42. Two flushing sheet gate rollers 45 are arranged at a point of connection between the second guide plate 42 and the main feeding passage 28. The flushing sheet feed roller 43 and the flushing sheet gate rollers 45 rotate in predetermined directions to feed the flushing sheet FS from the flushing sheet tray 41 onto the main feeding passage 28.

A third guide plate 46 for guiding the flushing sheet FS from the main feeding passage 28 to the flushing sheet tray 41 is arranged between the flushing sheet tray 41 and the drive roller 24. The third guide plate 46 is formed by two parallel, spaced, curved, and elongated plates. The main feeding passage 28 is connected to the third guide plate 46 by the selector 36.

The cleaning mechanism 47 for removing ink from a flushing sheet FS after flushing (flushed flushing sheet FS) is arranged on the third guide plate 46. The cleaning mechanism 47 includes two pressurizing rollers 48 and an ink storing case 49. The ink absorbed in the flushed flushing sheet FS is squeezed out of the flushing sheet FS as the flushing sheet FS passes through the pressurizing rollers 48. The ink squeezed out of the flushing sheet FS is stored in the ink storing case 49.

Two flushing sheet discharge rollers 51 for discharging the flushing sheet FS onto the flushing sheet tray 41 is arranged between the third guide plate 46 and the flushing sheet tray 41. When the selector 36 is in the tilted state (open state), the rotation of the feeding belt 23, the pressurizing rollers 48, and the flushing sheet discharge rollers 51 causes the flushing sheet FS to be discharged onto the flushing sheet tray 41 after the ink absorbed in the flushing sheet FS is removed by the cleaning mechanism 47. In the present embodiment, the position of the flushing sheet FS accommodated in the flushing sheet tray 41 is referred to as a non-flushing position and the position of the flushing sheet FS arranged immediately below the recording head 12 is referred to as a flushing position.

Figure 2:
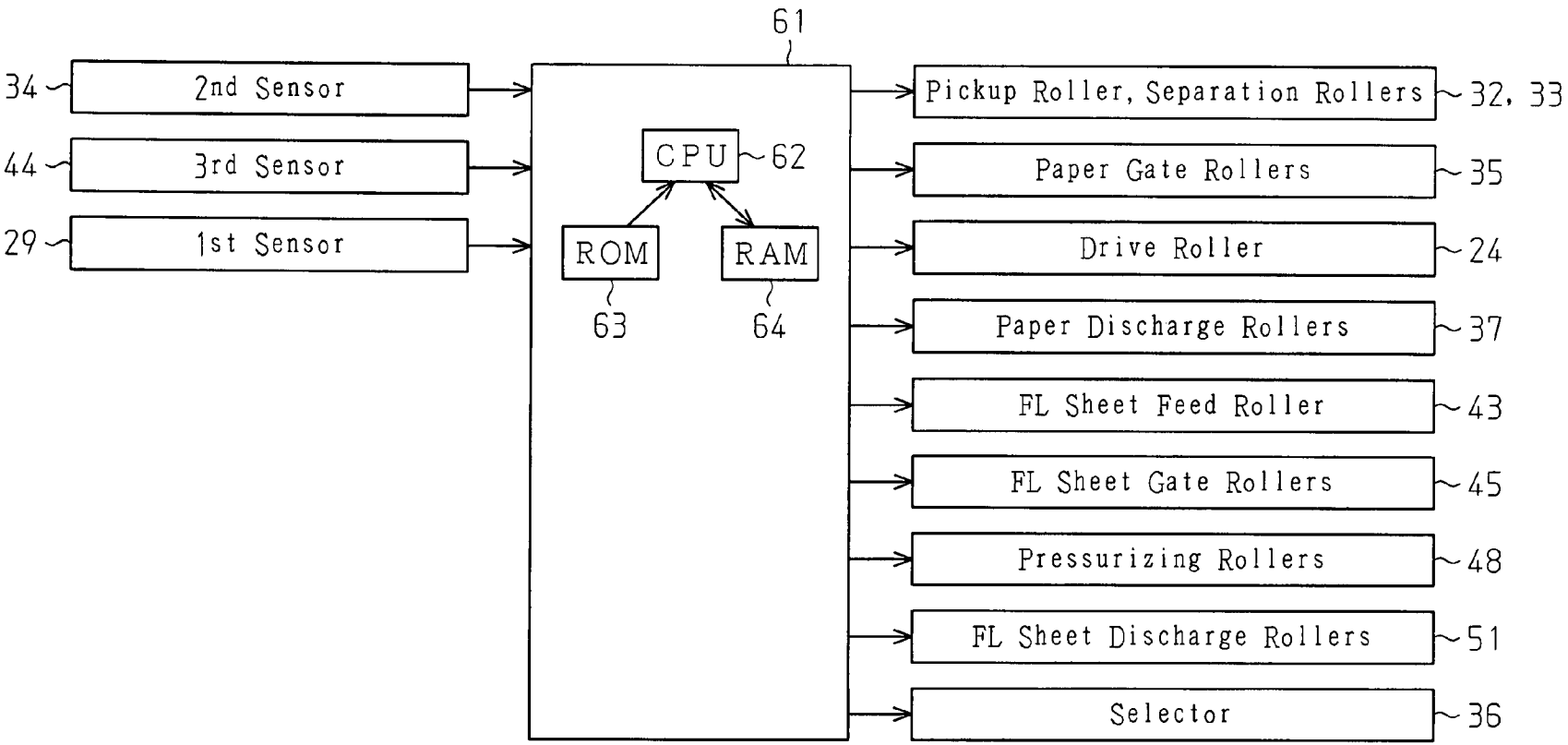
FIG. 2 is a block diagram showing an electrical circuit of the printer.

As shown in FIG. 2, the printer 10 includes a controller 61. The controller 61 includes a CPU 62, which is connected to a ROM 63 and a RAM 64. The ROM 63 stores, for example, control programs that are executed when the ink is ejected to a paper P or to a flushing sheet FS. The RAM 64 stores various data including detection signals that are provided from sensors.

The first sensor 29, the second sensor 34, and the third sensor 44 are connected to the input side of the controller 61. The pickup roller 32, the separation rollers 33, the paper gate rollers 35, the drive roller 24, the paper discharge rollers 37, the flushing sheet feed roller 43, the flushing sheet gate rollers 45, the pressurizing rollers 48, the flushing sheet discharge rollers 51, and the selector 36 are connected to the output side of the controller 61. The CPU 62 executes drive control of each mechanism (including the drive roller 24) based on detection signals provided from the sensors 29, 34, and 44.

During normal printing, the paper feed tray 21 and the paper discharge tray 22 are connected by the first guide plate 31 and the main feeding passage 28 to form a paper feeding passage for feeding a paper P. During flushing, the input side and the output side of the flushing sheet tray 41 are connected by the second guide plate 42, the main feeding passage 28, and the third guide plate 46 to form a flushing sheet feeding passage for feeding a flushing sheet FS.

When the selector 36 is in the horizontal state (closed state), a paper P picked out of the paper feed tray 21 is fed onto the main feeding passage 28 via the first guide plate 31. In this case, the feeding belt 23 is electrically charged. Thus, the paper P is attracted to and held on the feeding belt 23. Printing is started when the paper P is fed to the position immediately below the recording head 12. After printing is completed, the paper P is discharged from the main feeding passage 28 onto the paper discharge tray 22 via the selector 36.

When the selector 36 is in the tilted state (open state), a flushing sheet FS picked out of the flushing sheet tray 41 is fed to the main feeding passage 28 via the second guide plate 42. In this case, the feeding belt 23 is electrically charged. Thus, the flushing sheet FS is attracted to and held on the feeding belt 23. Flushing is started when the flushing sheet FS is fed to the position immediately below the recording head 12. The ink ejected from the nozzles 13 is absorbed by the flushing sheet FS. The flushed flushing sheet FS is fed from the main feeding passage 28 to the third guide plate 46 via the selector 36. The flushing sheet FS then passes through the pressurizing rollers 48 at which the ink absorbed in the flushing sheet FS is squeezed out. The flushing sheet FS is recollected in the flushing sheet tray 41.

A printing process including flushing will now be described in detail with reference to FIGS. 3 to 6. When the printing process is started, the selector 36 is in the horizontal state (closed state) as indicated by the solid line in FIG. 1. To measure the time interval at which flushing is to be performed, a flushing timer (not shown) starts a counting operation when the printing process is started. In the drawings, FL represents flushing.

Figure 3:
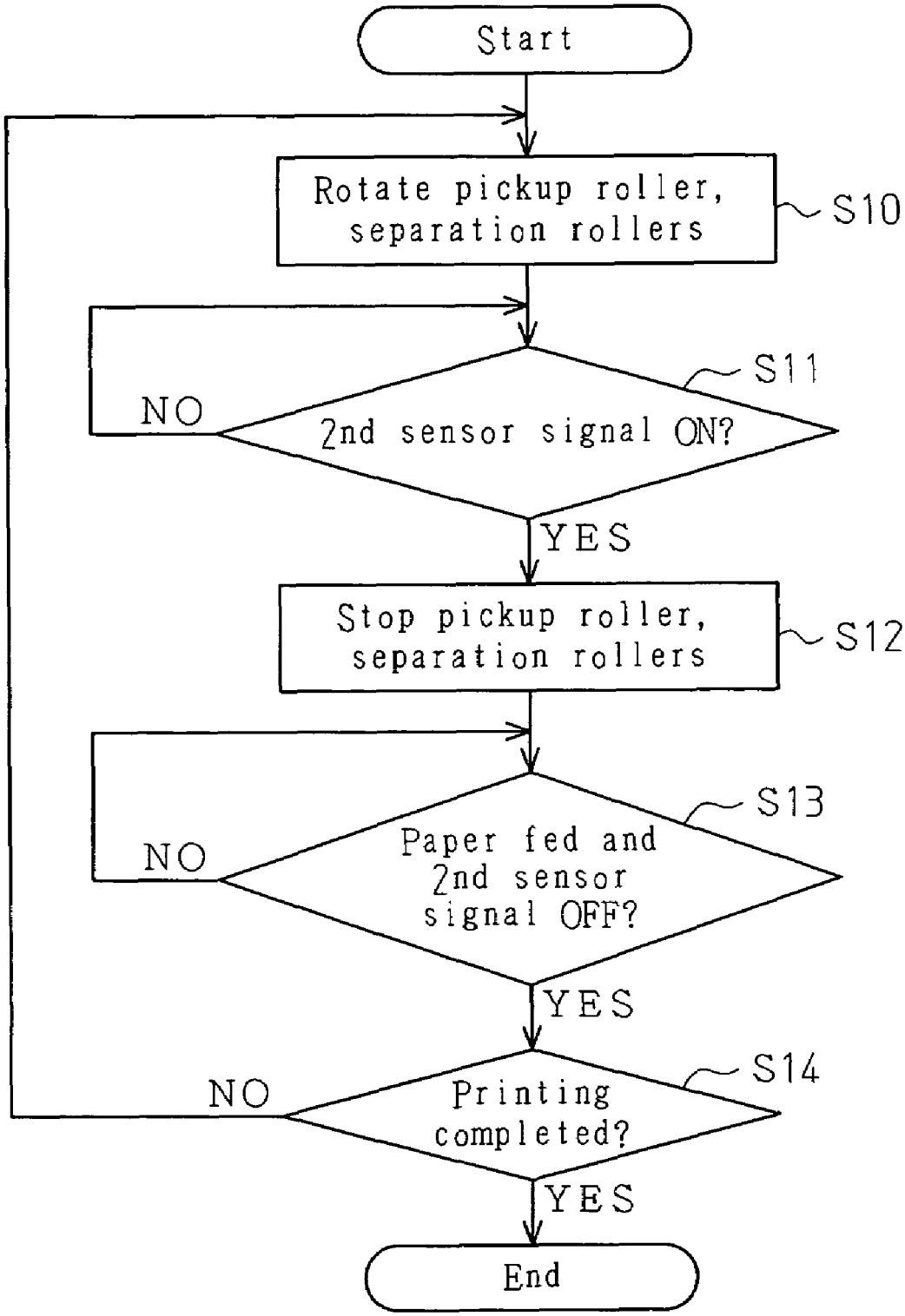
FIG. 3 is a flowchart showing a paper feed wait process.

FIG. 3 is a flowchart showing a paper feed wait process. This process is performed so that whenever a sheet of paper P is fed onto the main feeding passage 28, the next pieces of paper P would be waiting in the vicinity of the paper gate rollers 35.

Referring to FIG. 3, the CPU 62 rotates the pickup roller 32 and the separation rollers 33 when the printing process is started (S10). A paper P in the paper feed tray 21 is fed onto the first guide plate 31. Next, the CPU 62 determines whether the signal provided from the second sensor 34 is an ON signal, that is, whether the second sensor 34 has detected the paper P (S11). When the signal provided from the second sensor 34 is an OFF signal (S11: NO), the CPU 62 continues to rotate the pickup roller 32 and the separation rollers 33 and repeats the above determination (S11) until an ON signal is provided from the second sensor 34. When the signal provided from the second sensor 34 is an ON signal (S11: YES), the CPU 62 determines that the paper P has been fed to the vicinity of the paper gate rollers 35 and stops rotating the pickup roller 32 and the separation rollers 33 (S12).

Next, the CPU 62 determines whether a signal provided from the second sensor 34 is an OFF signal, that is, whether the paper P has been fed onto the main feeding passage 28 (S13). When the signal provided from the second sensor 34 is an ON signal (S13: NO), the CPU 62 rotates the pickup roller 32 and the separation rollers 33 repeats the above determination (S13) until an OFF signal is provided from the second sensor 34. When the signal provided from the second sensor 34 is an OFF signal (S13: YES), the CPU 62 determines that the paper P has passed the paper gate rollers 35 and has been fed onto the main feeding passage 28. Further, the CPU 62 determines whether printing on the fed paper P has been completed (S14). When printing has been completed (S14: YES), the CPU 62 ends the paper feed wait process. When printing has not been completed (S14: NO), the CPU 62 rotates the pickup roller 32 and the separation rollers 33 (S10) and repeats the above processing (S10 to S14) until printing is completed.

Figure 4:
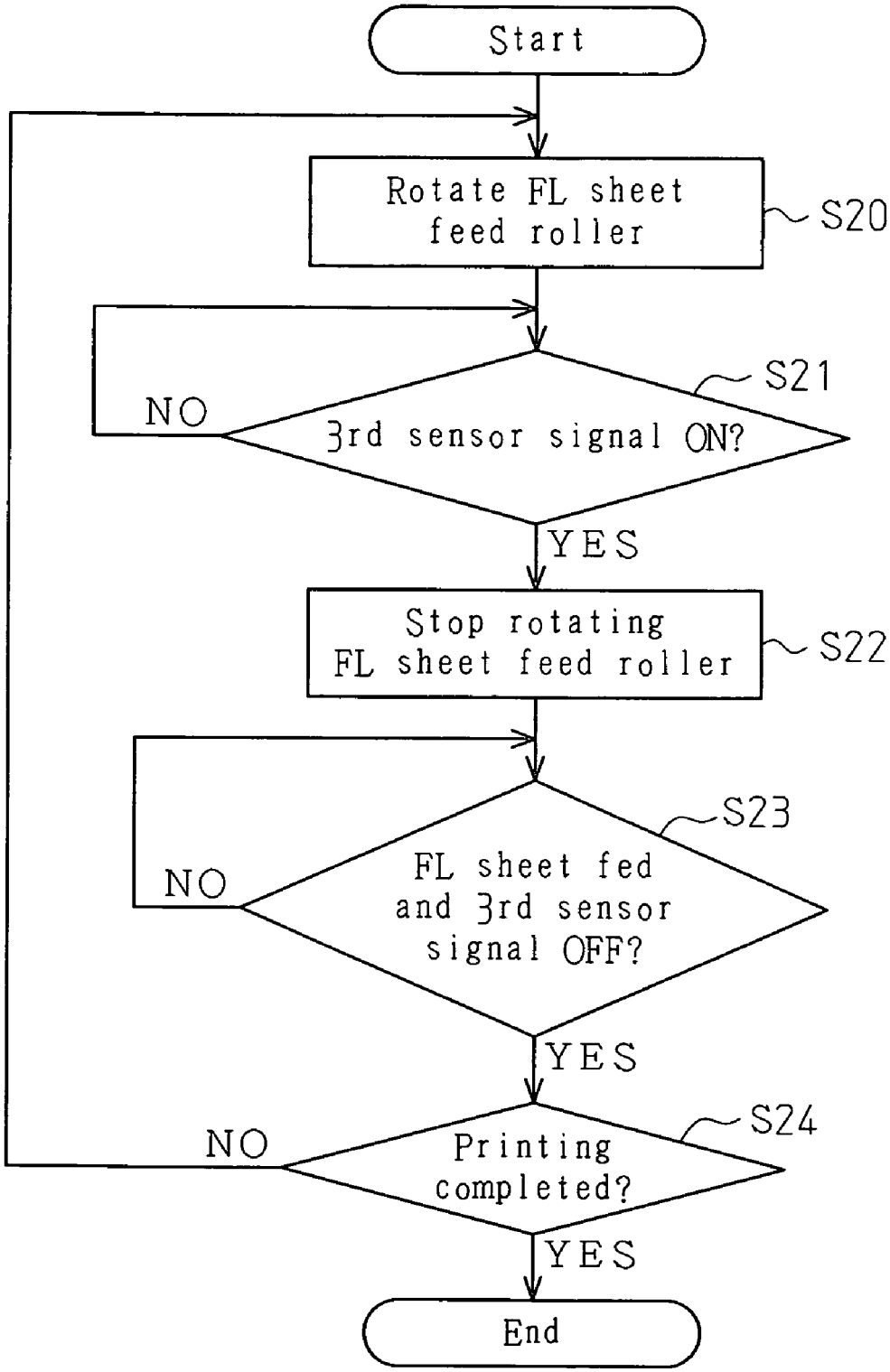
FIG. 4 is a flowchart showing a flushing sheet feed wait process.

FIG. 4 is a flowchart showing a flushing sheet wait process. This process is performed so that a flushing sheet FS that is to be fed next for a flushing operation is waiting in the vicinity of the flushing sheet gate rollers 45.

Referring to FIG. 4, the CPU 62 rotates the flushing sheet feed roller 43 when the printing process is started (S20). A flushing sheet FS in the flushing sheet tray 41 is fed onto the second guide plate 42. Next, the CPU 62 determines whether a signal provided from the third sensor 44 is an ON signal, that is, whether the third sensor 44 has detected the flushing sheet FS (S21). When the signal provided from the third sensor 44 is an OFF signal (S21: NO), the CPU 62 rotates the flushing sheet feed roller 43 and repeats the above determination (S21) until an ON signal is provided from the third sensor 44. When the signal provided from the third sensor 44 is an ON signal (S21: YES), the CPU 62 determines that the flushing sheet FS has been fed to the flushing sheet gate rollers 45 and stops rotating the flushing sheet feed roller 43 (S22).

Next, the CPU 62 determines whether a signal provided from the third sensor 44 is an OFF signal, that is, whether the flushing sheet FS has been fed onto the main feeding passage 28 (S23). When the signal provided from the third sensor 44 is an ON signal (S23: NO), the CPU 62 rotates the flushing sheet feed roller 43 and repeats the above determination (S23) until an OFF signal is provided from the third sensor 44. When the signal provided from the third sensor 44 is an OFF signal (S23: YES), the CPU 62 determines that the flushing sheet FS has passed the flushing sheet gate rollers 45 and has been fed onto the main feeding passage 28. Then, the CPU 62 determines whether printing on the fed paper P has been completed (S24). When printing has been completed (S24: YES), the CPU 62 ends the flushing sheet wait process. When printing has not been completed, the CPU 62 rotates the flushing sheet feed roller 43 (S20) and repeats the above processing (S20 to S24) until determining that printing has been completed.

Figure 5:
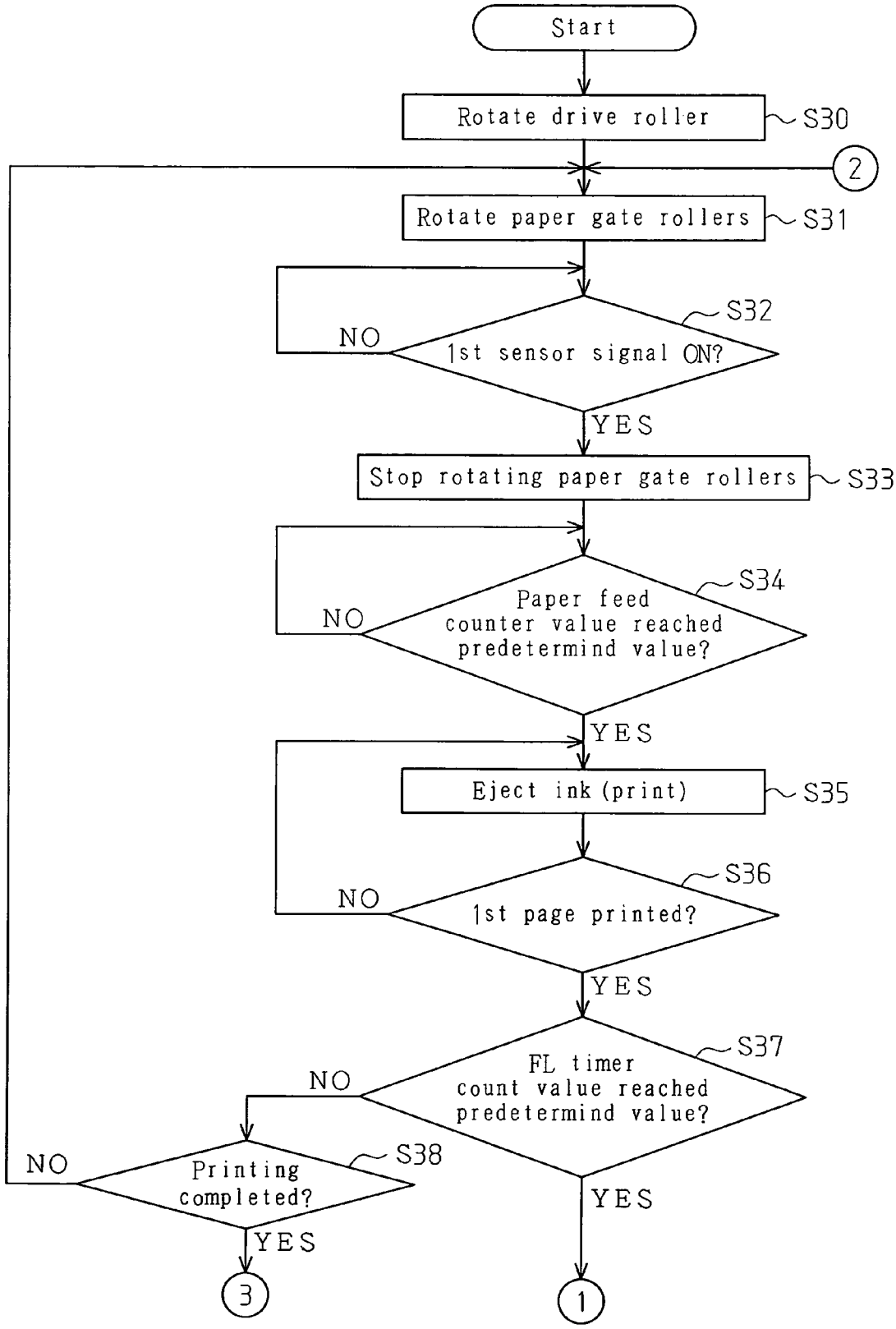
FIG. 5 is a flowchart showing a printing and flushing process.
Figure 6:
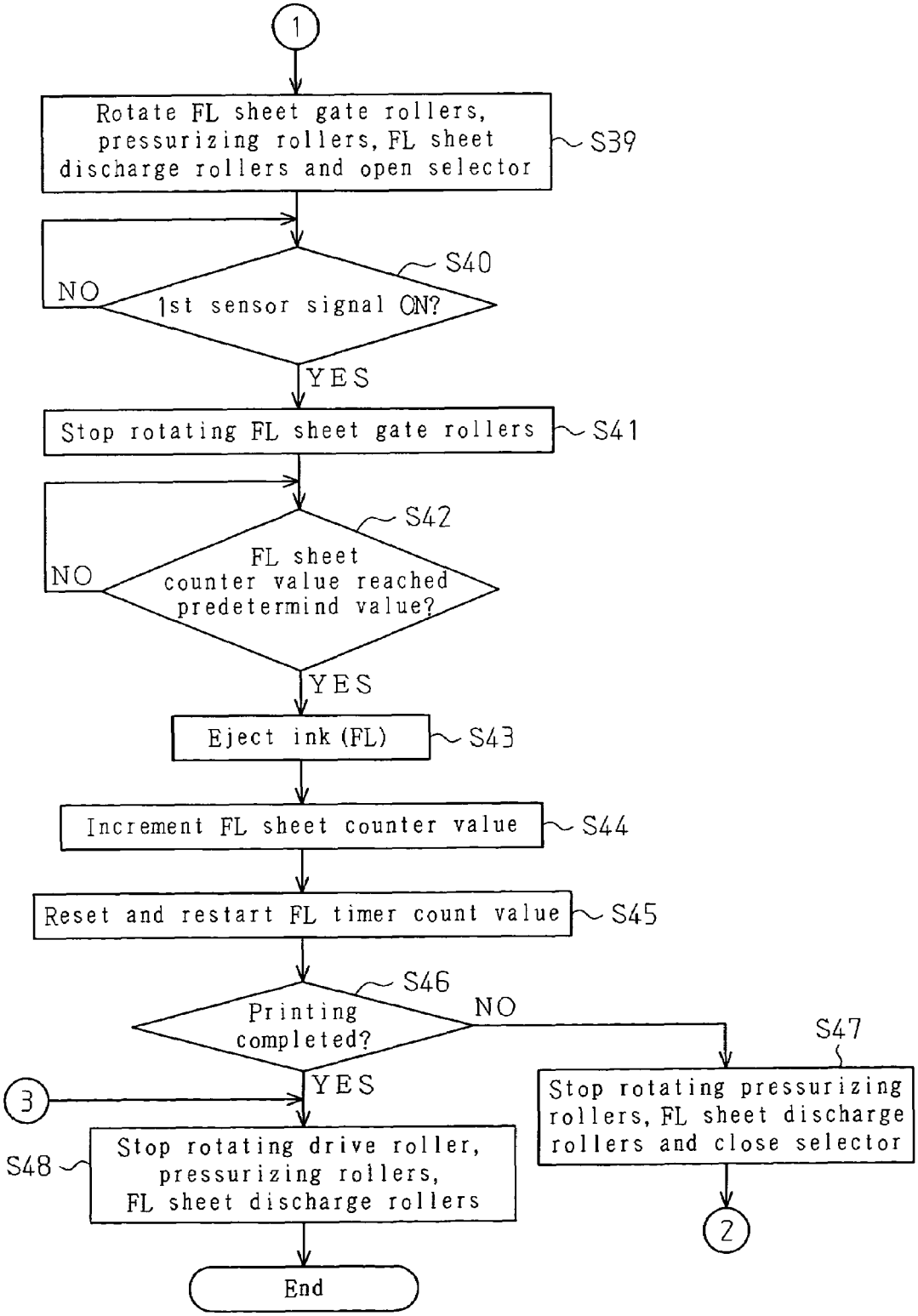
FIG. 6 is a flowchart showing the printing and flushing process.
Figure 7:
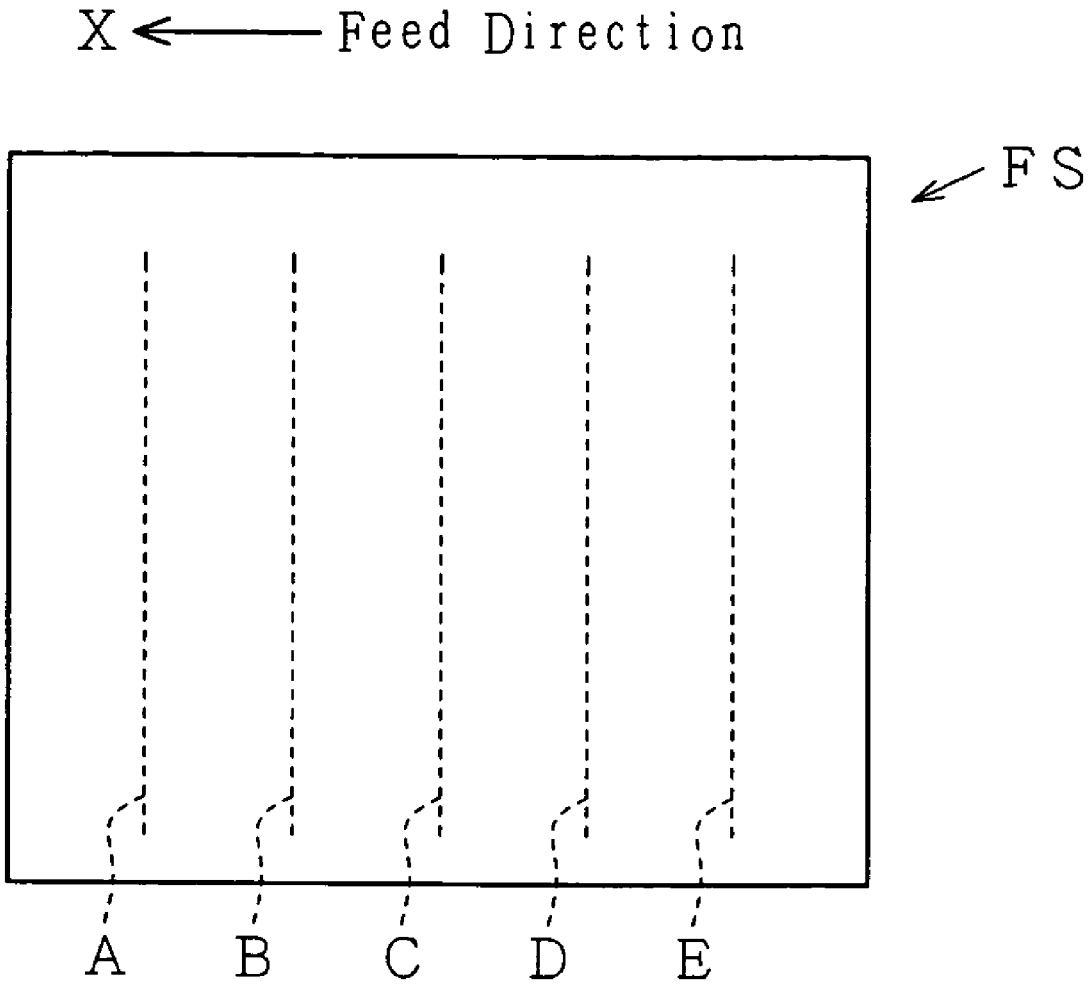
FIG. 7 is a plan view showing a flushing sheet.

In the present embodiment, a printing and flushing process shown in FIGS. 5 and 6 is performed in a state in which a paper P is waiting in the vicinity of the paper gate rollers 35 and a flushing sheet FS is waiting in the vicinity of the flushing sheet gate rollers 45. More specifically, the paper feed wait process, the flushing sheet wait process, and the printing and flushing process are performed in parallel.

Referring to FIG. 5, when the printing operation is started, the CPU 62 rotates the drive roller 24 (S30) and rotates the paper gate rollers 35 (S31). When the paper gate rollers 35 rotate, the paper P waiting in the vicinity of the paper gate rollers 35 is fed onto the main feeding passage 28. Next, the CPU 62 determines whether a signal provided from the first sensor 29 is an ON signal, that is, whether the first sensor 29 has detected the paper P (S32). When the signal provided from the first sensor 29 is an OFF signal (S32: NO), the CPU 62 rotates the drive roller 24 and the paper gate rollers 35 repeats the above determination (S32) until an ON signal is provided from the first sensor 29. When the signal provided from the first sensor 29 is an ON signal (S32: YES), the CPU 62 determines that the paper P has been fed to the recording head 12 and stops rotating the paper gate rollers 35 (S33).

Next, the CPU 62 determines whether its paper feed counter value has reached a predetermined value (S34). The paper feed counter value corresponds to a count amount of the CPU 62 obtained when feeding the paper P from the position of the first sensor 29 to the print position. When the printing process is started, the CPU 62 calculates the paper feed counter value in advance in accordance with print data and stores the calculated value in the RAM. When the paper feed counter reaches the predetermined value (S34: YES), the CPU 62 determines that the paper P has been fed to the position immediately below the recording head 12. The CPU 62 then ejects ink from the nozzles 13 of the recording head 12 to start printing on the paper P (S35).

Next, the CPU 62 determines whether printing of a first page on paper P has been completed (S36). When printing of a first page on paper P has not been completed (S36: NO), the CPU 62 continues printing until printing of the first page on paper P has been completed (S35). When printing of the first page of paper P has been completed (S36: YES), the CPU 62 determines whether a flushing timer count value has reached a predetermined value (S37). When the flushing timer has not reached the predetermined value (S37: NO), the CPU 62 determines whether printing has been completed (S38). When printing has not been completed (S38: NO), the CPU 62 repeats the above processing (S31 to S38) to perform printing of subsequent pages on papers P until the flushing timer count value reaches a predetermined value. When the flushing timer count value reaches the predetermined value (S37: YES), the CPU 62 performs the flushing described below.

The CPU 62 first rotates the flushing sheet gate rollers 45, the pressurizing rollers 48, and the flushing sheet discharge rollers 51. Further, the CPU 62 shifts the selector 36 to the open state (S39). When the flushing sheet gate rollers 45 rotate, the flushing sheet FS waiting in the vicinity of the flushing sheet gate rollers 45 is fed onto the main feeding passage 28. Next, the CPU 62 determines whether a signal provided from the first sensor 29 is an ON signal, that is, whether the first sensor 29 has detected the flushing sheet FS (S40). When the signal provided from the first sensor 29 is an OFF signal (S40: NO), the CPU 62 continues to feed the flushing sheet FS and repeats the above determination (S40) until an ON signal is provided from the first sensor 29. When the signal provided from the first sensor 29 is an ON signal (S40: YES), the CPU 62 determines that the flushing sheet FS has been fed to the vicinity of the recording head 12. The CPU 62 then stops rotating the flushing sheet gate rollers 45 (S41).

Next, the CPU 62 determines whether its flushing sheet counter value has reached a predetermined value (S42). The flushing sheet counter value corresponds to a count amount incremented by the CPU 62 whenever the flushing sheet FS is fed by a certain amount from the position of the first sensor 29 to the flushing position. The CPU 62 calculates the flushing sheet counter value based on the usage history of the flushing sheet FS and stores the calculated value into the RAM 64. When the flushing sheet counter has reached a predetermined value (S42: YES), the CPU 62 determines that the flushing sheet FS has been fed to the position immediately below the recording head 12. More specifically, the CPU 62 determines that a predetermined area of the flushing sheet FS is located immediately below the recording head 12. The CPU 62 then ejects ink from the nozzles of the recording head 12 to perform flushing (S43).

Next, the CPU 62 increments the flushing sheet counter value by a predetermined value (S44). In the present embodiment, the ink receiving area of the flushing sheet FS is changed for every flushing operation. More specifically, referring to FIG. 7, flushing is performed with one flushing sheet FS so that its ink receiving area A is used in a first flushing operation, its ink receiving area B is used in a second flushing operation, its ink receiving area C is used in a third flushing operation, its ink receiving area D is used in a fourth flushing operation, and its ink receiving area E is used in a fifth flushing operation. This enables the flushing sheet FS to efficiently absorb the ink. When the flushing sheets FS held in the flushing sheet tray 41 is each flushed five times, the CPU 62 displays a message indicating the need for replacement with new flushing sheets FS on a display unit of the printer 10.

After the flushing sheet counter is incremented, the CPU 62 resets and restarts the flushing timer (S45), and determines whether printing has been completed (S46). When printing has not been completed (S46: NO), the CPU 62 stops rotating the pressurizing rollers 48 and the flushing sheet discharge rollers 51. Further, the CPU 62 shifts the selector 36 to the closed state (S47). The CPU 62 then rotates the paper gate rollers 35 (S31), feeds a paper P for the next page, and starts printing on the next page of paper (S31 to S46). When printing has been completed (S45: YES or S38: YES), the CPU 62 stops rotating the drive roller 24, the pressurizing rollers 48, and the flushing sheet discharge rollers 51 (S48), and ends the process.

The first embodiment has the advantages described below.

(1) The cleaning mechanism 47 removes ink from each flushing sheet FS. This enables each flushing sheet FS to be used repeatedly (five times in the present embodiment) without waiting until the flushing sheet FS dries naturally. Further, each flushing sheet FS is efficiently reused and flushing is may be performed even when a large number of pages are printed. This reduces the replacement frequency of the flushing sheet FS since it may be used repeatedly. Thus, the possibility of the user staining his or hands and clothes with ink is reduced.

(2) The feeding belt 23 is used by both the paper feeding mechanism 14 and the flushing sheet feeding mechanism 15. This simplifies the entire structure of the apparatus.

(3) The electric-charging roller 38 electrically charges the feeding belt 23 to enable the flushing sheet FS to be attracted to and held on the feeding belt 23. This simplifies the mechanism for holding the flushing sheet FS on the feeding belt 23.

(4) Ink is squeezed out and removed from the flushing sheet FS as the flushing sheet FS passes through the pressurizing rollers 48. With this method, the removal of ink from the flushing sheet FS is simplified and ensured as compared with the wiping of the flushing sheet FS.

Second Embodiment

A second embodiment of the present invention will now be described with reference to FIG. 8. Components in the second embodiment that are the same as the components in the first embodiment will not be described in detail.

Figure 8:
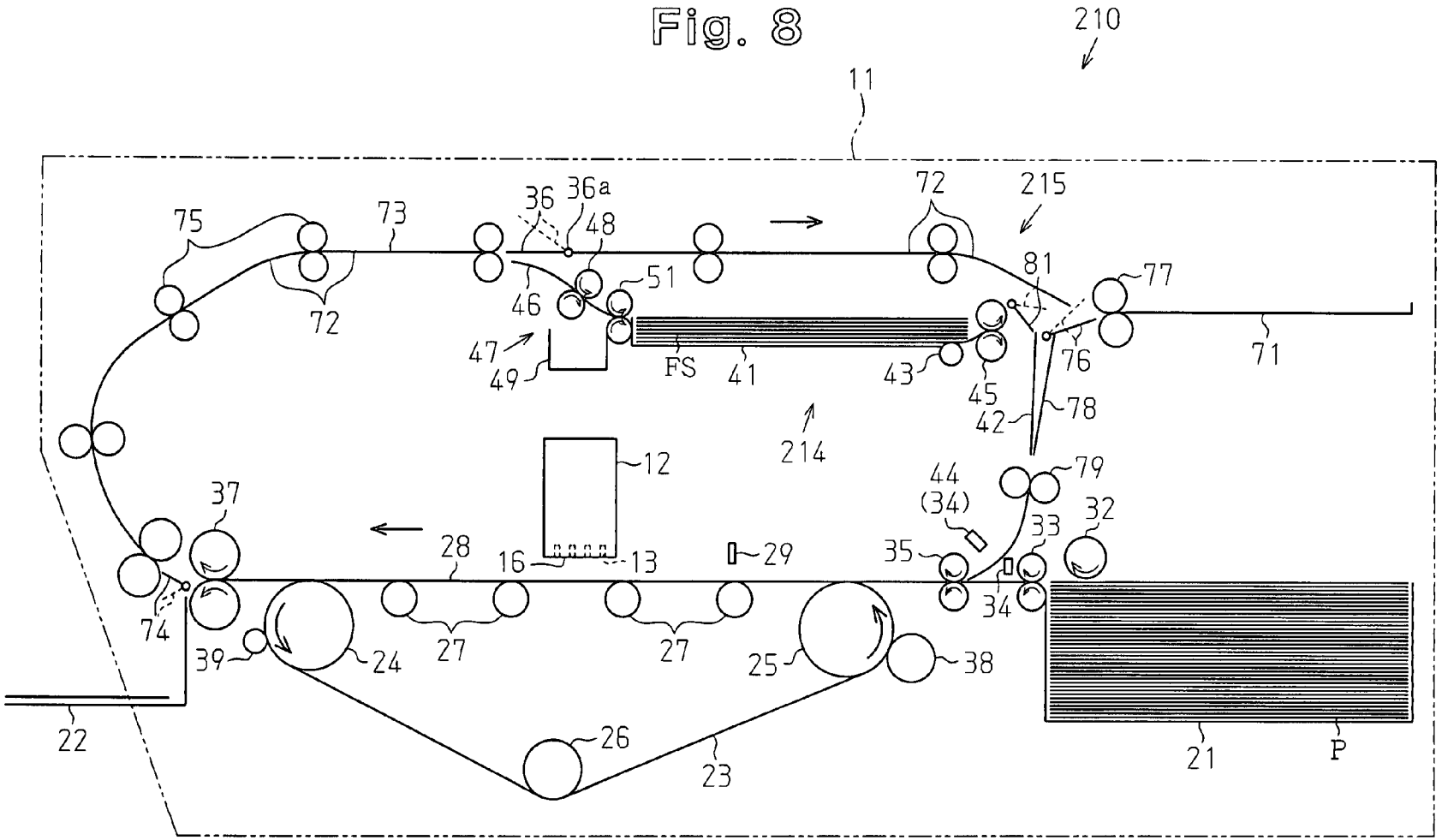
FIG. 8 is a schematic view showing an overall structure of a printer according to a second embodiment of the present invention.

As shown in FIG. 8, a paper feeding mechanism 214 (double-side ejection target feeding mechanism) and a flushing sheet feeding mechanism 215 are arranged in a main body case 11 so as to surround a recording head 12.

A temporary accommodation tray 71 and a plurality of guide plates 72 are arranged on a paper feeding passage for feeding a paper P. The temporary accommodation tray 71 temporarily accommodates a paper of which one side has been printed. A port of the temporary accommodation tray 71 is connected to the end of a main feeding passage 28 located near a paper discharge tray 22 via paper discharge rollers 37, a double-side printing passage selector 74, the guide plates 72, auxiliary rollers 75, and etc. The port of the temporary accommodation tray 71 is also connected to the other end of the main feeding passage 28 located near a paper feed tray 21 via a switchback selector 76, switchback rollers 77, a fourth guide plate 78, double-side printing gate rollers 79, paper gate rollers 35, and etc.

The switchback selector 76 may be connected to the temporary accommodation tray 71 as indicated by the solid line in FIG. 8. In this state, when the switchback rollers 77 rotate in a predetermined direction, a paper P on the guide plate 72 is fed into the temporary accommodation tray 71. The switchback selector 76 may tilt upward as indicated by the broken line in FIG. 8 to connect the temporary accommodation tray 71 and the fourth guide plate 78. In this state, when the switchback rollers 77 rotate in a predetermined direction, the paper P accommodated in the temporary accommodation tray 71 is fed onto the main feeding passage 28 via the double-side printing gate rollers 79.

During double-side printing, the paper P of which front side has been printed is turned over when fed to a double-side printing feeding passage 73. The paper P is accommodated into the temporary accommodation tray 71 with its print surface facing downward (its rear surface facing upward). When the switchback selector 76 is switched and the rotating direction of the switchback rollers 77 is switched, the paper P is fed onto the main feeding passage 28 via the double-side printing gate rollers 79 and the paper gate rollers 35 with its rear surface kept facing upward. In the present embodiment, the double-side printing feeding passage 73 is formed by the plurality of guide plates 72 and the fourth guide plate 78.

The flushing sheet feeding mechanism 215 is arranged above the recording head 12. A selector 36 is arranged on the double-side printing feeding passage 73. The selector 36 is shifted to feed a flushing sheet FS to a cleaning mechanism 47. The flushing sheet feeding mechanism 215 further includes a flushing sheet double-side selector 81. The flushing sheet double-side selector 81 selects whether to feed a flushing sheet FS that has passed through flushing sheet gate rollers 45 into the temporary accommodation tray 71 (whether to feed a flushing sheet FS with its ink receiving surface facing upward or with its ink receiving surface facing downward).

When the flushing sheet double-side selector 81 is connected to the second guide plate 42 as indicated by the solid line in FIG. 8, the flushing sheet FS is fed onto the main feeding passage 28. When the flushing sheet double-side selector 81 is not connected to the second guide plate 42 as indicated by a broken line in FIG. 8 and the switchback selector 76 is connected to the temporary accommodation tray 71 as indicated by the solid line in FIG. 8, the flushing sheet FS is fed into the temporary accommodation tray 71. In the same manner as for the paper P, the flushing sheet FS is fed from the temporary accommodation tray 71 to the main feeding passage 28 when the switchback selector 76 is switched and the rotating direction of the switchback rollers 77 is switched.

The flushing operation is performed when a predetermined time elapses during normal printing as in the first embodiment. Further, when the double-side printing passage selector 74 is switched to a downward tilted state (open state) as indicated by the broken line in FIG. 8, the paper P on which printing has been completed is discharged onto the paper discharge tray 22. The flushed flushing sheet FS is always fed onto the double-side printing feeding passage 73, passes the cleaning mechanism 47, and is then fed into the flushing sheet tray 41.

As described above, the passage for feeding the paper P and the passage for feeding the flushing sheet FS partially overlap each other. More specifically, the main feeding passage 28, part of the double-side printing feeding passage 73, and the fourth guide plate 78 are used by both the paper feeding mechanism 214 and the flushing sheet feeding mechanism 215. As a result, the mechanism for enabling double-side printing of the paper P (the double-side printing feeding passage 73, the switchback selector 76, the switchback roller, etc.) also enables double-side flushing of the flushing sheet FS.

The second embodiment has the advantages described below.

(5) The printer 210 of the second embodiment is embodied as a printer that performs double-side printing. In this case, partial use of the passage for feeding the paper P to feed the flushing sheet FS enables double-side flushing of the flushing sheet FS. This enables the flushing sheet FS to be used efficiently.

Third Embodiment

A third embodiment of the present invention will now be described with reference to FIG. 9. Components in the third embodiment that are the same as the components in the first embodiment will not be described in detail.

Figure 9:
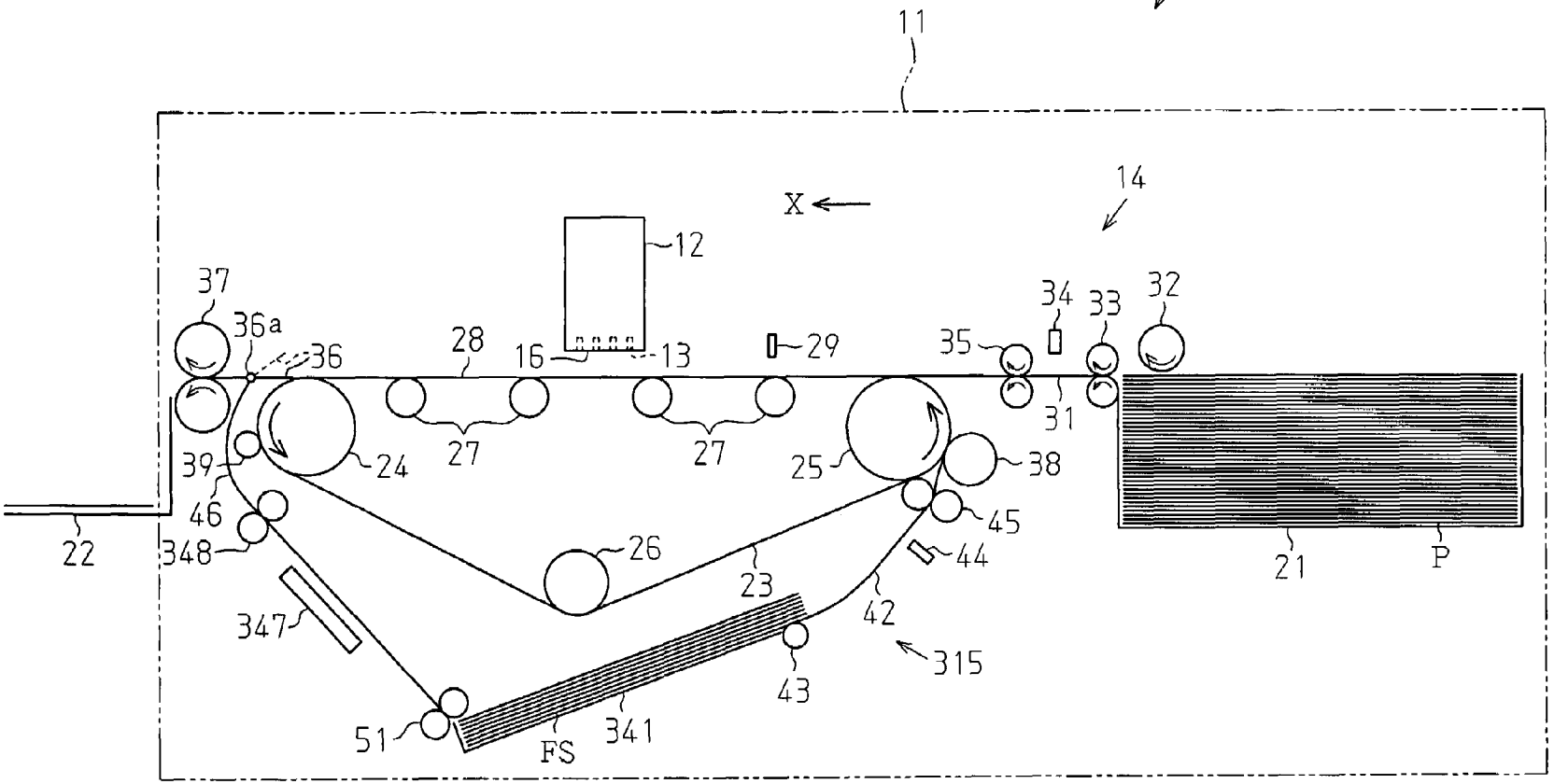
FIG. 9 is a schematic view showing an overall structure of a printer according to a third embodiment of the present invention.

As shown in FIG. 9, a flushing sheet tray 341 accommodates a plurality of (e.g. 100) flushing sheets FS that are placed one on top of another. The flushing sheet tray 341 is arranged in a manner that ends (exit side portions) of the flushing sheets FS that are closer to a driven roller 25 are tilted upward. This arrangement enables the flushing sheets FS to be easily picked out from the flushing sheet tray 341. The entire flushing sheet tray 341 forms part of a passage for feeding a flushing sheet FS. The flushing sheet feeding passage includes a main feeding passage 28 of a feeding belt 23 for feeding a flushing sheet FS to a position immediately below a recording head 12. That is, the feeding belt 23 is used by both a paper feeding mechanism 14 and a flushing sheet feeding mechanism 315.

Two flushing sheet feed rollers 348 for feeding a flushed flushing sheet FS onto the flushing sheet tray 341 is arranged on a third guide plate 46. A heater 347, which functions as a drying unit for drying the flushed flushing sheet FS, is arranged between the flushing sheet feed rollers 348 and the flushing sheet tray 341.

In the present embodiment, when a selector 36 is in a tilted state, a flushing sheet feed roller 43 takes out the lowest flushing sheet FS from the flushing sheet tray 341. The flushing sheet FS taken out from the flushing sheet tray 341 is fed onto the main feeding passage 28 via a second guide plate 42. Flushing is started when the flushing sheet FS is fed to the position immediately below the recording head 12. The flushed flushing sheet FS is fed from the main feeding passage 28 onto the third guide plate 46 via the selector 36. The flushing sheet FS is dried when passing by the vicinity of the heater 347 and is then fed onto the highest flushing sheet FS in the flushing sheet tray 341. To ensure that the flushing sheet FS is completely dried, the rotation speed of the flushing sheet feed rollers 348 and the flushing sheet discharge rollers 51 may be lowered from normal when the flushing sheet FS passes by the vicinity of the heater 347.

In the present embodiment, the flushed flushing sheet FS is dried with the heater 347. This enables each of the ink receiving areas A to E of one flushing sheet FS to be used in a plurality of flushing operations. When all of the flushing sheets FS in the flushing sheet tray 341 are each flushed five times, ink is ejected again into the ink receiving area A of one flushing sheet FS in the next flushing operation. Thereafter, ink is ejected again into the ink receiving area B, the ink receiving area C, the ink receiving area D, and the ink receiving area E in the stated order in the subsequent flushing operations. When the flushing sheets FS in the flushing sheet tray 341 are each flushed ten times, a message indicating the need for replacing with new flushing sheets FS is displayed on a display unit (not shown) of the printer 310. In this case, when one hundred flushing sheets are accommodated in the flushing sheet tray 341, flushing is enabled for one thousand times in total. This structure reduces the frequency at which the flushing sheets FS need to be replaced. The number of flushing operations performed using each of the ink receiving areas A to E may be changed. Further, the order of the ink receiving areas A to E used in flushing operations may be changed in a manner for example that the ink is ejected into the ink receiving area A in the first and second flushing operations and the ink is ejected into the ink receiving area B in the third and fourth flushing operations.

Further, the flushing sheet FS may be used for purposes other than flushing. For example, characters may be printed on the flushing sheet FS for nozzle checking purpose. In this case, the print state of the characters may be checked visually to detect whether the ejection direction of the ink is deviated because of the ink adhered to the nozzles 13.

The third embodiment has the advantages described below.

(6) The flushing sheet FS, which differs from that used in the previous flushing is fed to the flushing position. In other words, the same flushing sheet FS is not used in consecutive flushing operations. Thus, the flushing sheet FS, which has high ink absorbency, is constantly fed to the flushing position. This enables each flushing sheet FS to be used efficiently. This structure is particularly advantageous when applied to a full-line head printer that reuses the flushing sheets FS.

(7) The lowest flushing sheet FS is taken out of the flushing sheet tray 341. The flushing sheet FS is then returned and fed onto the highest flushing sheet FS in the flushing sheet tray 341. This simple method enables all the flushing sheets FS in the flushing sheet tray 341 to be used repeatedly.

(8) The heater 347 is used to dry the flushed flushing sheet FS. This enables each of the ink receiving areas A to E of the same flushing sheet FS to be used in a plurality of flushing operations. Further, each flushing sheet FS is reused efficiently and flushing is enabled even when a large number of pages are printed. This reduces the frequency in which the flushing sheets FS are replaced, and the possibility of the user staining his or her hands and clothes with ink is lowered. Further, each flushing sheet FS has high ink absorbency when a flushing operation is performed. This enables flushing to be performed in an appropriate manner even when a flushing is performed frequently with a small number of flushing sheets FS in the flushing sheet tray 341. Further, the flushing sheets FS containing no ink are always accommodated in the flushing sheet tray 341. This prevents the inner surface of the flushing sheet tray 341 from being stained by the ink.

Fourth Embodiment

A fourth embodiment of the present invention will now be described with reference to FIGS. 10 to 14. Components in the fourth embodiment that are the same as the components in the third embodiment will not be described in detail. A printer 410 of the fourth embodiment has the marginless printing function for printing on the entire surface of a paper P, which functions as a target.

Figure 10:
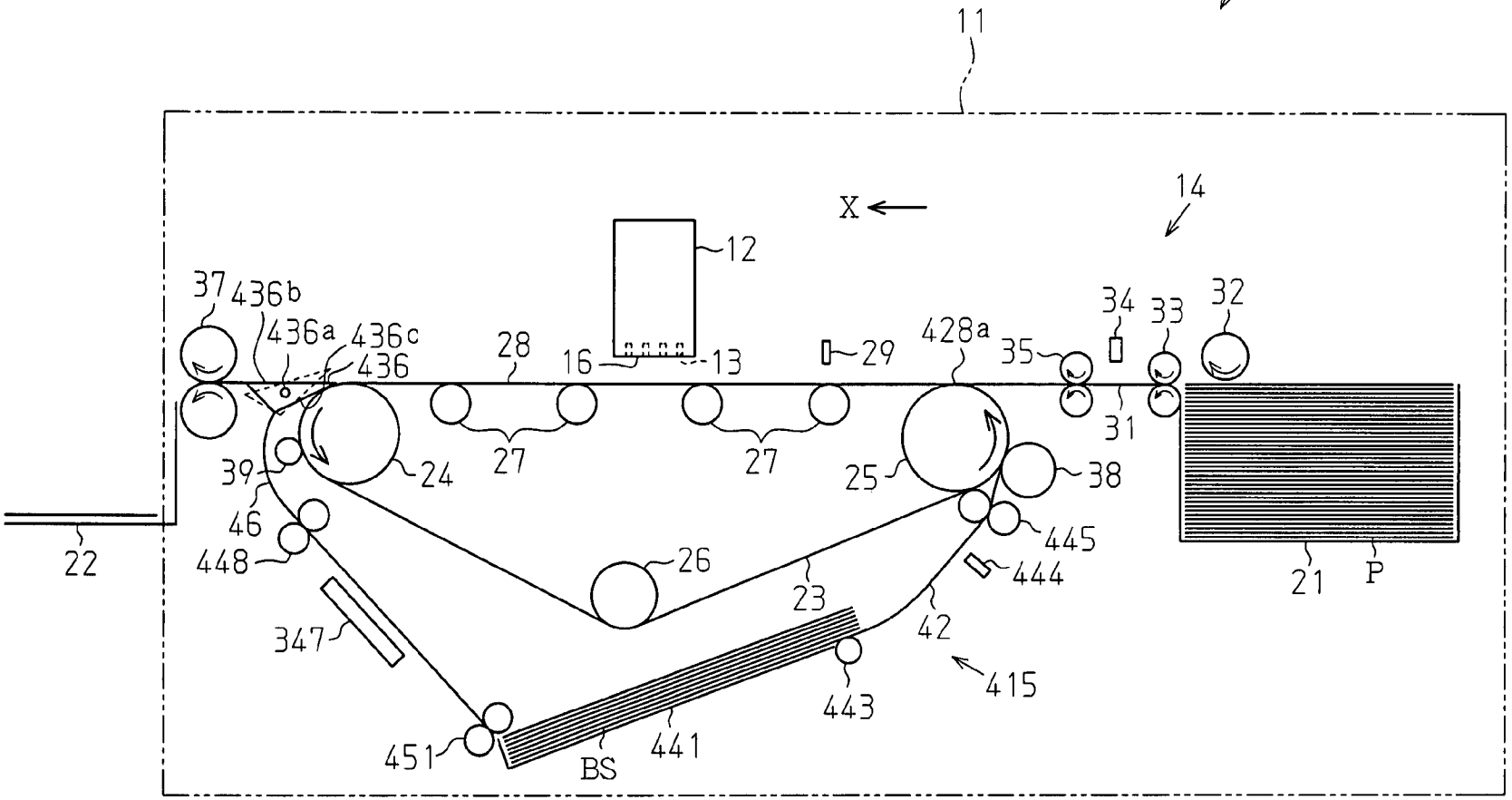
FIG. 10 is a schematic view showing an overall structure of a printer according to a fourth embodiment of the present invention.

As shown in FIG. 10, a paper feeding mechanism (target feeding mechanism) 14 for feeding a paper P and a base sheet feeding mechanism (liquid receiving sheet feeding mechanism) 415 for feeding a base sheet BS, which functions as a liquid receiving sheet, are arranged in a main body case 11. The base sheet BS is used to absorb ink ejected outside the paper P during marginless printing. The base sheet BS is formed, for example, from a nonwoven fabric of chemical fibers, such as polyethylene terephthalate (PET). It is preferable that the base sheet BS have a volume resistivity of $10^8$ to $10^{10}$ Ω/cm. In the present embodiment, the paper feeding mechanism 14 and the base sheet feeding mechanism 415 form a feeding mechanism.

A separator 436 having a wedge-shaped cross-section is arranged between a feeding belt 23 and a paper discharge tray 22. The separator 436 switches between a state for feeding a paper P from a main feeding passage 28 to the paper discharge tray 22 and a state for feeding a base sheet BS from the main feeding passage 28 to a heater 347. The separator 436 is supported in a rotatable manner about a shaft 436*a*, which extends in a direction perpendicular to the feeding direction of the paper P. The separator 436 rotates to switch between a horizontal state (closed state) indicated by a solid line in FIG. 10 and a tilted state (open state) indicated by a broken line in FIG. 10.

When the separator 436 is in the horizontal state (closed state), the main feeding passage 28 and paper discharge rollers 37 are connected via the separator 436. In this state, when the feeding belt 23 and the paper discharge rollers 37 rotate, the printed paper P is discharged onto the paper discharge tray 22 via the main feeding passage 28, the separator 436, and the paper discharge roller 37.

In the present embodiment, a joining point 428*a* at which the feeding passage of the paper P joins the feeding passage of the base sheet BS is formed on the main feeding passage 28. This feeds the paper P overlapped with the base paper BS on the main feeding passage 28 towards the recording head 12. The position of the base sheet BS accommodated in a base sheet tray 441 and the position of the paper P accommodated in the paper feed tray 21 are defined as liquid non-ejection positions. The position immediately below the recording head 12 is defined as a liquid ejection position.

The marginless printing process will now be described with reference to FIGS. 11 to 14.

Figure 11:
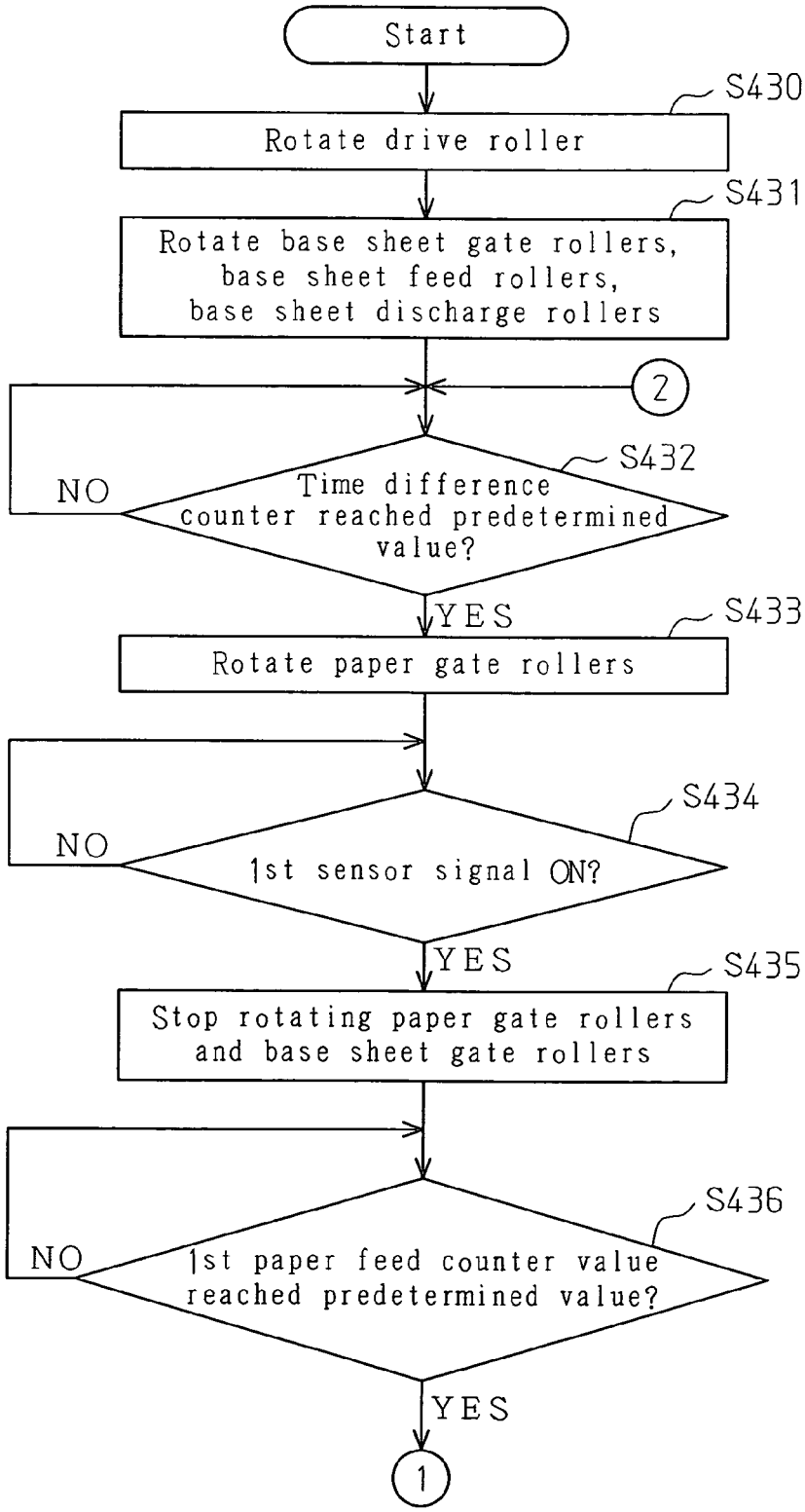
FIG. 11 is a flowchart showing a marginless printing process.
Figure 12:
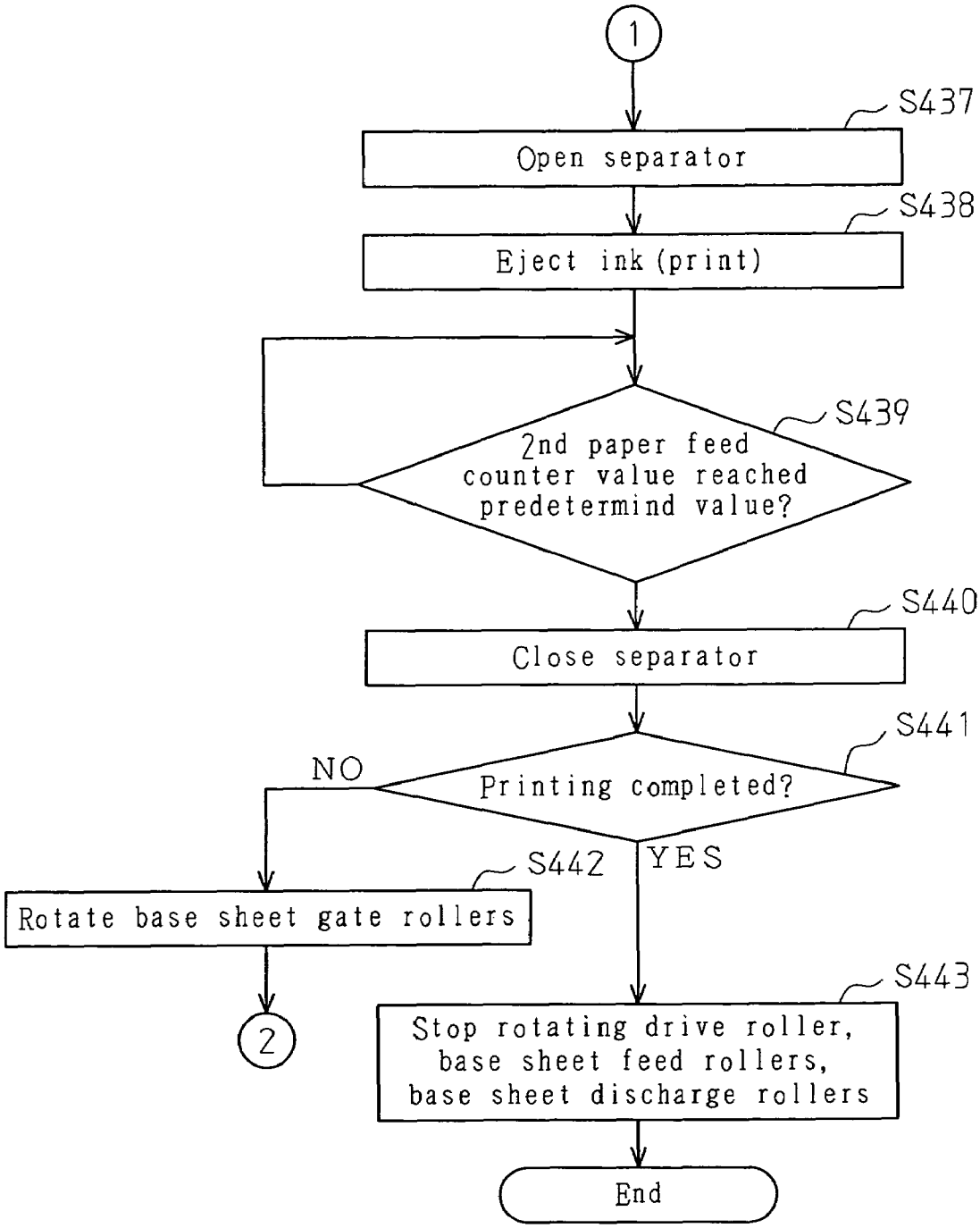
FIG. 12 is a flowchart showing the marginless printing process.

Marginless printing process is performed in a state in which a paper P is waiting in the vicinity of a paper gate rollers 35 and a base sheet BS is waiting in the vicinity of a base sheet gate rollers 445. That is, the paper feed wait process shown in FIG. 3, a base sheet wait process, and the marginless printing process shown in FIGS. 11 and 12 are performed in parallel. The base sheet wait process is performed through the same routine as the flushing sheet wait process shown in FIG. 4 and is not described in detail.

Figure 13:
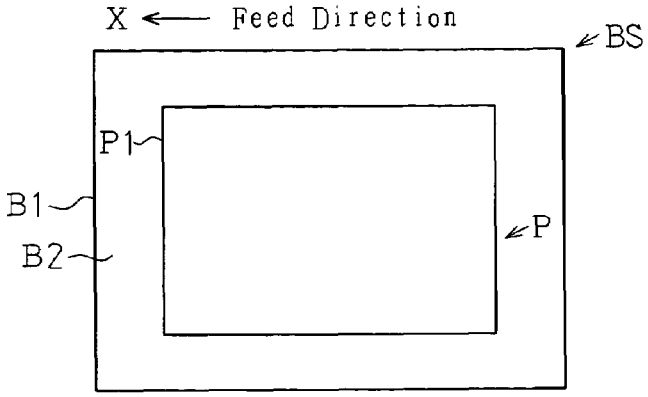
FIG. 13 is a plan view showing a state in which a base sheet is placed on a paper.

As shown in FIG. 11, when the marginless printing process is started, the CPU 62 rotates a drive roller 24 (S430) and rotates the base sheet gate rollers 445, base sheet feed rollers 448, and base sheet discharge rollers 451 (S431). As a result, the base sheet BS waiting in the vicinity of the base sheet gate rollers 445 is fed onto the main feeding passage 28. Next, the CPU 62 determines whether its time difference counter value has reached a predetermined value (S432). The time difference counter value corresponds to the amount the base sheet BS is fed to the main feeding passage 28 from the position of a fourth sensor 444. The CPU 62 calculates in advance the time difference counter value in accordance with print data, and stores the calculated value into the RAM 64. The CPU 62 feeds the base sheet BS onto the main feeding passage 28 before feeding the paper P onto the main feeding passage 28 based on the time difference counter value. As a result, a distal end B1 of the base sheet BS is offset from a distal end P1 of the paper P but is set at a position away from the distal end P1 in the feeding direction (X direction in FIG. 13) as shown in FIG. 13. Thus, the base sheet BS has a distal portion B2 on which the paper P does not reach. As a result, the paper P is arranged in substantially the middle part of the base sheet BS.

When the time difference counter has not reached the predetermined value (S432: NO), the CPU 62 continues to feed the base sheet BS and repeats the above determination (S432) until the time difference counter has reached the predetermined time. When the time difference counter value has reached the predetermined time (S432: YES), the CPU 62 determines that the distal portion B2 of the base sheet BS has reached the joining point 428*a*, and rotates the paper gate rollers 35 (S433). As a result, the paper P waiting in the vicinity of the paper gate rollers 35 is fed onto the main feeding passage 28.

Next, the CPU 62 determines whether a signal provided from a first sensor 29 is an ON signal (S434). When the signal provided from the first sensor 29 is an OFF signal (S434: NO), the CPU 62 repeats the above determination (S434) until an ON signal is provided from the first sensor 29. When the signal provided from the first sensor 29 is an ON signal (S434: YES), the CPU 62 determines that the paper P (base sheet BS) has been fed to the vicinity of the recording head 12 and stops rotating the paper gate rollers 35 and the base sheet gate rollers 445 (S435).

Next, the CPU 62 determines whether its first paper feed counter has reached a predetermined value (S436). The first paper feed counter value corresponds to the amount the paper P (base sheet BS) is fed from the first sensor 29 toward the print position. The CPU 62 calculates in advance the first paper feed counter value in accordance with the print data when the printing process is started and stores the calculated value into the RAM 64. When the first paper feed counter has not reached the predetermined value (S436: NO), the CPU 62 repeats the above determination (S436) until the first paper feed counter reaches the predetermined value.

When the first paper feed counter has reached the predetermined value (S436: YES), the CPU 62 determines that the paper P (base sheet BS) has been fed to the position immediately below the recording head 12 (liquid ejection position). In this state, the CPU 62 rotates the separator 436 to switch the separator 436 from the horizontal state (closed state) to the tilted state (open state) (S437). The CPU 62 then ejects ink from the nozzles 13 of the recording head 12 to perform printing on the paper P (S438).

Next, the CPU 62 determines whether its second paper feed counter has reached a predetermined value (S439). The second paper feed counter value corresponds to the amount the paper P (base sheet BS) is fed from the print position towards the separator 436. The CPU 62 calculates in advance the second paper feed counter value in accordance with print data when the printing process is started and stores the calculated value into the RAM. When the second paper feed counter has not reached the predetermined value (S439: NO), the CPU 62 repeats the above determination (S439) until the second paper feed counter reaches the predetermined value. When the second paper feed counter has reached the predetermined value (S439: YES), the CPU 62 determines that the paper P (base sheet BS) has been fed to the vicinity of the separator 436. The CPU 62 then rotates the separator 436 to switch the separator 436 from the tilted state (open state) to the horizontal state (closed state) (S440).

Afterwards, the CPU 62 determines whether printing has been completed (S441). When printing has not been completed (S441: NO), the CPU 62 rotates the base sheet gate rollers 445 (S442). The CPU 62 returns to the determination as to whether the time difference counter has reached the predetermined value (S432), and repeats the above printing processing (S432 to S441) until printing is completed. When printing is completed (S441: YES), the CPU 62 stops rotating the drive roller 24, the base sheet feed rollers 448, and the base sheet discharge rollers 451 (S443), and ends the process.

As described above, when the marginless printing operation is started, from a state in which the paper P and the base sheet BS are respectively waiting in the vicinity of the paper gate rollers 35 and the base sheet gate rollers 445, the base sheet BS is first fed onto the main feeding passage 28 and then the paper P is fed onto the main feeding passage 28. When the paper P reaches the joining point 428*a*, the paper P is placed on the base sheet BS (refer to FIG. 13). The paper P is then fed toward the recording head 12 on the main feeding passage 28 together with the base sheet BS.

Figure 14A:
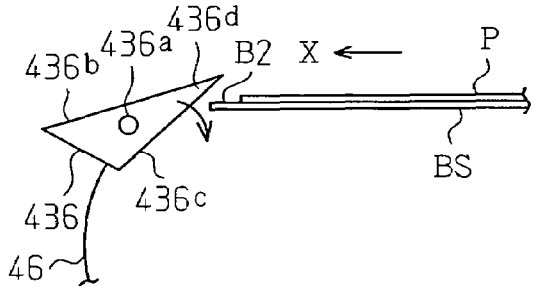
FIG. 14(A) is a schematic view showing the operation of a separator.
Figure 14B:
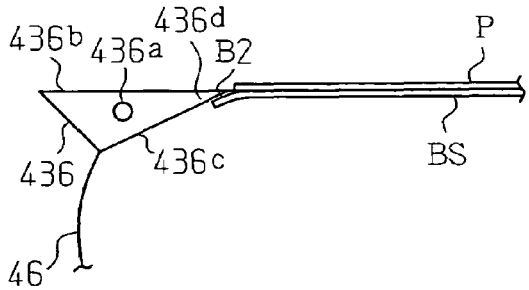
FIG. 14(B) is a schematic view showing the operation of the separator.

When the paper P is fed to the position immediately below the recording head 12, the ink is ejected from the nozzles 13 and marginless printing is performed. The ink ejected outside the outer rim of the paper P is absorbed by the base sheet BS. The base sheet BS used in marginless printing is fed on the main feeding passage 28 toward the separator 436. When the paper P and the base sheet BS reach the separator 436, the separator 436 rotates downward about the shaft 436*a* as shown in FIG. 14(A). Then, the distal portion B2 of the base sheet BS (portion that does not overlap with the paper P) is pressed down by a distal end 436*d* of the separator 436 as shown in FIG. 14(B).

Figure 14C:
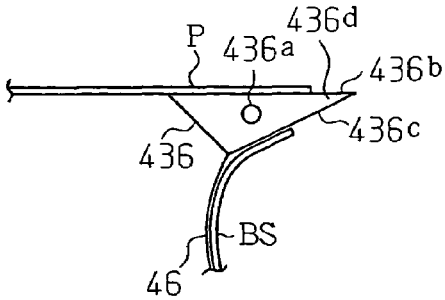
FIG. 14(C) is a schematic view showing the operation of the separator.

As shown in FIG. 14(*c*), the separator 436 is maintained in the horizontal state. The base sheet BS is separated gradually from the paper P by the distal end 436*d* of the separator 436. The base sheet BS is guided by a lower surface 436*c* of the separator 436 and is fed onto the third guide plate 46. The base sheet BS fed onto the third guide plate 46 is dried by the heater 347 and then recollected in the base sheet tray 441. The paper P is guided by an upper surface 436*b* of the separator 436, fed through the paper discharge rollers 37, and discharged onto the paper discharge tray 22. The upper surface 436*b* of the separator 436 forms part of the feeding passage of the paper P. The lower surface 436*c* of the separator 436 forms part of the feeding passage of the base sheet BS.

The printer may have functions other than the marginless printing function. For example, only the base sheet feeding mechanism 415 may be driven to detect deviation of the ejection direction in the same manner as in the third embodiment. Alternatively, only the paper feeding mechanism 14 may be driven to perform normal printing.

The fourth embodiment has the advantages described below.

(9) The ink ejected outside the paper P during marginless printing is absorbed by the base sheet BS. This prevents the inner surface of the main body case 11 from being stained by the liquid. Further, the paper P and the base sheet BS are fed to the position immediately below the recording head 12 in a manner that the paper P and the base sheet BS are arranged substantially at the same level. In this case, the ink ejected outside the paper P is not subjected to air resistance. Thus, the ink ejected outside the paper P is not atomized. Further, this structure saves the trouble of manually setting the base sheet BS on the paper P or manually separating the paper P from the base sheet BS.

(10) The feeding belt 23 is used by both the base sheet feeding mechanism 415 and the paper feeding mechanism 14. This simplifies the entire structure of the apparatus.

(11) The paper P is fed after the base sheet BS is fed to the joining point 428*a* of the main feeding passage 28 so that the paper P is placed on the base sheet BS. The base sheet BS has the distal portion B2 on which the paper P does not reach. This enables the paper P to be arranged at the substantially middle part of the base sheet BS.

(12) The separator 436 is rotated so that the paper P is easily separated from the base sheet BS after marginless printing. Further, the separator 436 has a wedge shape. Thus, the paper P is guided by the upper surface 436*b* of the separator 436 and fed smoothly onto the paper discharge tray 22. Further, the base sheet BS is guided by the lower surface 436*c* of the separator 436 and fed smoothly onto the base sheet tray 441.

(13) The ink absorbed by the base sheet BS is dried with the heater 347. Thus, the inner surface of the base sheet tray 441 is not stained by the ink. Further, the base sheet BS is repeatedly usable.

It should be apparent to those skilled in the art that the present invention may be embodied in many other specific forms without departing from the spirit or scope of the invention. Particularly, it should be understood that the present invention may be embodied in the following forms.

In the first and second embodiments, instead of squeezing off ink from the flushing sheet FS, ink may be wiped off, drawn off, or blown off from the flushing sheet FS.

In the first and second embodiments, the flushing sheet feeding mechanism and the paper feeding mechanism may use separate feeding belts 23.

In the first and second embodiments, the flushing sheet FS may be mechanically held on the feeding belt 23 by, for example, a holder.

In the third embodiment, a flushing sheet FS (e.g. an intermediate layer) other than the lowest flushing sheet FS in the flushing sheet tray 341 may be picked out and fed onto the main feeding passage 28. The flushing sheets FS may be used in any order as long as the same flushing sheet FS is not used in consecutive flushing operations.

In the third and fourth embodiments, instead of the heater 347, which functions as a drying unit, a passage bypassing the feeding passage and extending from the selector 36 or the separator 436 to the flushing sheet tray 341 may be formed. In this case, the flushed flushing sheet FS is dried naturally while the flushing sheet FS is being fed along the bypassing passage. Alternatively, pressurizing rollers or an air blower may be used instead of the heater 347.

In the fourth embodiment, the separator 436 may be eliminated. In this case, the paper P may be manually separated from the base sheet BS after marginless printing. Further, the separator 436 may have a cross-section that does is not wedge-shape. It is only required that the distal portion B2 of the base sheet BS be pressed down to separate the base sheet BS from the paper P when the distal end 436*d* of the separator 436 moves downward.

In the fourth embodiment, the relative positions of the base sheet BS and the paper P may be changed whenever marginless printing is performed. The relative positions of the base sheet BS and the paper P may be changed by changing the time difference counter value. In this case, a part of the base sheet BS that differs from the part that absorbed ink in the first marginless printing operation may be used to absorb ink in the next marginless printing operation. In this case, even when the drying of the base sheet BS with the heater 347 is insufficient, the ink absorption ratio of the base sheet BS does not decrease.

In the fourth embodiment, the base sheet BS and the paper P may be fed to the joining point 428*a* of the main feeding passage 28 at substantially the same timing. In this case, the paper P is first placed on the base sheet BS and then moved to the substantially middle part of the base sheet BS.

In the fourth embodiment, the base sheet BS may be used as a flushing sheet for use in a flushing operation. More specifically, the base sheet feeding mechanism 415, which corresponds to the flushing sheet feeding mechanism, may be driven to feed only the base sheet BS as a flushing sheet onto the main feeding passage 28, and the flushing process may be performed on the sheet.

In the first to fourth embodiments, the present invention may be embodied in a printer other than the full-line head type printer. Further, the liquid ejection apparatus may be an apparatus other than a printer and may be printing apparatuses including a facsimile and a copier, liquid ejection apparatuses for ejecting an electrode material or a color material of a liquid crystal display, an EL (electroluminescence) display, or a surface emitting display, or liquid ejection apparatuses for ejecting living organisms for use in manufacturing a biochip, or a sample ejection apparatus as a precision pipette. Further, the liquid should not be limited to ink but may be a liquid other than the ink.

The present examples and embodiments are to be considered as illustrative and not restrictive, and the invention is not to be limited to the details given herein, but may be modified within the scope and equivalence of the appended claims.

The invention claimed is:

1. A liquid ejection apparatus for ejecting liquid to a target, the apparatus comprising:

a liquid ejection head including a liquid ejection nozzle;

a flushing sheet feeding mechanism for feeding a flushing sheet from a non-flushing position separated from the liquid ejection nozzle to a flushing position facing the liquid ejection nozzle and from the flushing position to the non-flushing position during a flushing operation, wherein the flushing sheet absorbs liquid ejected from the liquid ejection nozzle; and a cleaning mechanism, arranged on a passage for feeding the flushing sheet, for removing the liquid absorbed in the flushing sheet after the flushing sheet is used in the flushing operation, wherein the flushing sheet feeding mechanism includes a feed belt for feeding the target to the position facing the liquid ejection nozzle.

2. The liquid ejection apparatus according to claim 1, wherein the cleaning mechanism includes a pressurizing roller for squeezing liquid out of the flushing sheet by pressurizing the flushing sheet after the flushing operation.

3. The liquid ejection apparatus according to claim 1, wherein the feed belt is electrically charged to attract the flushing sheet.

4. The liquid ejection apparatus according to claim 1, further comprising:

a double-side ejection target feeding mechanism for feeding the target to the position facing the liquid ejection nozzle to eject liquid to two sides of the target, wherein a passage for feeding the target and the passage for feeding the flushing sheet partially overlap each other.

5. A liquid ejection apparatus for ejecting liquid to a target, the apparatus comprising:

a liquid ejection head including a liquid ejection nozzle;

an accommodation unit for accommodating a plurality of flushing sheets for absorbing liquid ejected from the liquid ejection nozzle in a flushing operation at a non-flushing position separated from the liquid ejection nozzle; and a flushing sheet feeding mechanism for feeding the flushing sheets from the accommodation unit to a flushing position facing the liquid ejection nozzle and from the flushing position to the accommodation unit, wherein the flushing sheet feeding mechanism takes out one of the flushing sheets, which differs from a flushing sheet used in a previous flushing operation, from the accommodation unit and feeds the taken out flushing sheet to the flushing position, wherein the flushing sheet feeding mechanism takes out a lowest one of the plurality of flushing sheets, which are placed one on top of another, from the accommodation unit, feeds the lowest one of the plurality of flushing sheets to the flushing position, and feeds the lowest one of the plurality of flushing sheets after the flushing operation onto a highest one of the flushing sheets in the accommodation unit.

6. The liquid ejection apparatus according to claim 5, wherein the flushing sheet feeding mechanism takes out the flushing sheets from the accommodation unit from those that have been fed earlier from the flushing position to the accommodation unit.

7. The liquid ejection apparatus according to claim 5, further comprising:

a drying device, arranged on a passage for feeding the flushing sheet, for drying the flushing sheet after the flushing operation.

8. The liquid ejection apparatus according to claim 5, wherein the flushing sheet feeding mechanism includes a feed belt for feeding the target to the position facing the liquid ejection nozzle.

9. The liquid ejection apparatus according to claim 8, wherein the feed belt is electrically charged to attract the flushing sheet.

10. A liquid ejection apparatus for ejecting a liquid to a target, the apparatus comprising:

a liquid ejection head including a liquid ejection nozzle;

a target accommodation unit for accommodating the target at a liquid non-ejection position separated from the liquid ejection head;

a liquid receiving sheet accommodation unit for accommodating a liquid receiving sheet having a larger size than the target at the liquid non-ejection position; and a feeding mechanism for feeding the target, which is fed from the target accommodation unit, to a liquid ejection position facing the liquid ejection head when the target is placed on the liquid receiving sheet, which is fed from the liquid receiving sheet accommodation unit, during a marginless ejection operation for ejecting the liquid to the entire surface of the target.

11. The liquid ejection apparatus according to claim 10, wherein:

the feeding mechanism includes a target feeding mechanism for feeding the target from the target accommodation unit to the liquid ejection position and a liquid receiving sheet feeding mechanism for feeding the liquid receiving sheet from the liquid receiving sheet accommodation unit to the liquid ejection position; and a passage for feeding the target is joined to a passage for feeding the liquid receiving sheet.

12. The liquid ejection apparatus according to claim 11, further comprising:

a controlling unit for driving the target feeding mechanism and the liquid receiving sheet feeding mechanism, wherein the controlling unit drives the target feeding mechanism and the liquid receiving sheet feeding mechanism so that the target reaches a joining point of the passage for feeding the liquid receiving sheet and the passage for feeding the target when a predetermined time elapses after the liquid receiving sheet passes the joining point.

13. The liquid ejection apparatus according to claim 11, further comprising:

a separator, arranged on the passage for feeding the liquid receiving sheet, for separating the target from the liquid receiving sheet.

14. The liquid ejection apparatus according to claim 13, wherein the separator has a wedge-shaped cross-section, is arranged on the passage for feeding the liquid receiving sheet, rotates about an axis perpendicular to a feeding direction of the liquid receiving sheet, and removes the liquid receiving sheet from the target when the separator rotates downward about the shaft.

15. The liquid ejection apparatus according to claim 13, wherein the passage for feeding the liquid receiving sheet is formed to feed the liquid receiving sheet from the liquid ejection position to the liquid receiving sheet accommodation unit via the separator after the liquid receiving sheet is used in the marginless ejection operation.

* * * * *